US011634290B2

(12) United States Patent
Matsumoto

(10) Patent No.: US 11,634,290 B2
(45) Date of Patent: Apr. 25, 2023

(54) SHEET CONVEYANCE APPARATUS AND IMAGE FORMING APPARATUS

(71) Applicant: CANON KABUSHIKI KAISHA, Tokyo (JP)

(72) Inventor: Yasuaki Matsumoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 17/126,174

(22) Filed: Dec. 18, 2020

(65) Prior Publication Data

US 2021/0198070 A1 Jul. 1, 2021

(30) Foreign Application Priority Data

Dec. 25, 2019 (JP) ..... JP2019-235145

(51) Int. Cl.

| | |
|---|---|
| ***B65H 5/06*** | (2006.01) |
| ***B65H 9/20*** | (2006.01) |
| ***B65H 5/36*** | (2006.01) |
| ***B65H 7/14*** | (2006.01) |
| ***B65H 7/04*** | (2006.01) |

(52) U.S. Cl.

CPC ..... *B65H 5/062* (2013.01); *B65H 5/36* (2013.01); *B65H 7/04* (2013.01); *B65H 7/14* (2013.01); *B65H 9/20* (2013.01); *B65H 2404/74* (2013.01); *B65H 2511/51* (2013.01);

(Continued)

(58) Field of Classification Search

CPC . B65H 5/062; B65H 5/36; B65H 5/38; B65H 7/02; B65H 7/04; B65H 7/14; B65H 2404/152; B65H 2404/1521; B65H 2404/74; B65H 2511/51; B65H 2511/515; B65H 2553/30; B65H 2553/40; B65H 2553/41; B65H 2553/412; B65H 2553/414; B65H 2553/81

See application file for complete search history.

(56) References Cited

U.S. PATENT DOCUMENTS

| | | | |
|---|---|---|---|
| 8,340,563 | B2 | 12/2012 | Nakajima et al. |
| 10,254,698 | B2 | 4/2019 | Matsumoto |

(Continued)

FOREIGN PATENT DOCUMENTS

| | | | |
|---|---|---|---|
| JP | 2010-260662 | A | 11/2010 |
| JP | 2016-003066 | A | 1/2016 |

(Continued)

*Primary Examiner* — Prasad V Gokhale
(74) *Attorney, Agent, or Firm* — Venable LLP

(57) ABSTRACT

A sheet conveyance apparatus includes a receiving member to hold a sheet pressing portion and receive a reaction force of an urging portion for urging the sheet pressing portion toward the first sheet guide, a detection unit having a first detection portion disposed on a first sheet guide, and a second detection portion facing the first detection portion and disposed on a second sheet guide. The detection unit changes an output value based on presence and absence of the sheet at a detection position in a sheet conveyance path, wherein the second guide provided with the second detection portion, and a receiving member are movably disposed with respect to the first guide provided with the first detection portion respectively, and are positioned with respect to the first guide independently from each other, and wherein the receiving member is pivotably supported around the pivot axis independently from the second guide.

21 Claims, 13 Drawing Sheets

(52) U.S. Cl.
CPC .... *B65H 2511/515* (2013.01); *B65H 2553/30* (2013.01); *B65H 2553/41* (2013.01); *B65H 2553/81* (2013.01)

(56) References Cited

U.S. PATENT DOCUMENTS

| | | | | |
|---|---|---|---|---|
| 2016/0139550 | A1* | 5/2016 | Ishida | B65H 5/062 399/45 |
| 2019/0063901 | A1* | 2/2019 | Mitsui | G01B 11/0691 |
| 2021/0061597 | A1 | 3/2021 | Matsumoto | |

FOREIGN PATENT DOCUMENTS

| | | | |
|---|---|---|---|
| JP | 2016-055933 | A | 4/2016 |
| JP | 2019-104635 | A | 6/2019 |

* cited by examiner

SHEET CONVEYANCE APPARATUS AND IMAGE FORMING APPARATUS

BACKGROUND OF THE INVENTION

Field of the Invention

The present invention relates to a sheet conveyance apparatus which conveys a sheet, and an image forming apparatus including this sheet conveyance apparatus.

Description of the Related Art

Hitherto, an image forming apparatus including a detection portion which detects a grammage and surface properties of a sheet by irradiating the sheet being conveyed in a conveyance path with an ultrasonic wave and light is suggested (refer to Japanese Patent Laid-Open No. 2016-55933). This image forming apparatus includes a pair of guides forming the conveyance path, and a pressing roller pressing the sheet onto a first guide of the pair of guides. This pressing roller stabilizes a posture of the sheet conveyed in the conveyance path, and improves detection accuracy of the grammage and surface properties of the sheet by use of the ultrasonic wave and the light.

However, the pressing roller disclosed in Japanese Patent Laid-Open No. 2016-55933 is urged by a pressing spring, and a reaction force of the pressing spring is received, for example, by a second guide of the pair of guides. It occurred that the second guide sustained creep deformation when the reaction force of the pressing spring had acted on the second guide for an extended period of time. Then, in a case where the second guide has been deformed, it occurs that the detection accuracy is deteriorated due to changes in a distance between detection elements of the detection portion, and a detection position of the sheet.

SUMMARY OF THE INVENTION

According to a first aspect of the present invention, a sheet conveyance apparatus includes a first guide configured to guide a sheet, a second guide disposed to face the first guide, and configured to form a conveyance path together with the first guide, a conveyance portion configured to convey a sheet in the conveyance path, a pressing portion configured to press the sheet being conveyed in the conveyance path against the first guide, an urging portion configured to urge the pressing portion in an urging direction toward the first guide, a receiving member configured to hold the pressing portion and receive a reaction force of the urging portion, and a detection unit including a first detection portion disposed on the first guide, and a second detection portion facing the first detection portion and disposed on the second guide, the detection unit being configured to change an output value based on presence and absence of the sheet at a detection position in the conveyance path, wherein the second guide provided with the second detection portion, and the receiving member are movably disposed with respect to the first guide provided with the first detection portion respectively, and are configured to be positioned with respect to the first guide independently from each other.

According to a second aspect of the present invention, a sheet conveyance apparatus includes a first guide configured to guide a sheet, a second guide disposed to face the first guide, and configured to form a conveyance path together with the first guide, a conveyance portion configured to convey a sheet in the conveyance path, a pressing portion configured to press the sheet being conveyed in the conveyance path against the first guide, an urging portion configured to urge the pressing portion in an urging direction toward the first guide, a receiving member configured to hold the pressing portion and receive a reaction force of the urging portion, and a detection unit including a detection portion disposed on the second guide, the detection unit being configured to change an output value based on presence and absence of the sheet at a detection position in the conveyance path, wherein the second guide provided with the detection portion, and the receiving member are movably disposed with respect to the first guide respectively, and are configured to be positioned with respect to the first guide independently from each other.

Further features of the present invention will become apparent from the following description of exemplary embodiments with reference to the attached drawings.

DESCRIPTION OF THE EMBODIMENTS

First Embodiment

General Configuration

First, a first embodiment of the present disclosure will be described. A printer 1, which is an image forming apparatus, is a laser beam printer of an electrophotographic system forming a monochrome toner image. To be noted, in the following descriptions, a sheet means the sheet on which an image is formed by the printer 1, and includes, for example, such as a paper and an overhead transparency (OHP).

Figure 1:
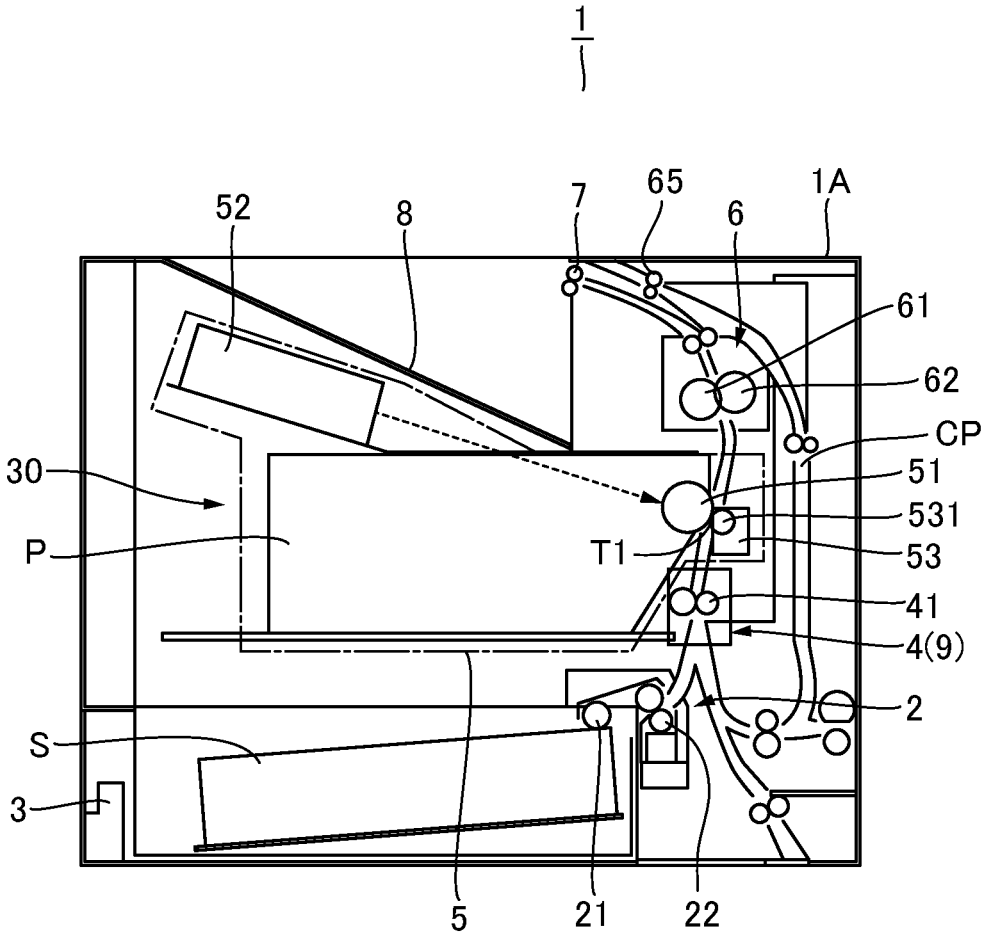
FIG. 1 is a schematic general view showing a printer according to a first embodiment.

The printer 1, as shown in FIG. 1, includes a feed unit 2 to feed a stacked sheet S, and a sheet conveyance apparatus 4 including a conveyance roller pair 41 to convey the sheet S conveyed by the feed unit 2. Further, the printer 1 includes an image forming portion 30 forming the image on the sheet S conveyed by the conveyance roller pair 41, a fixing unit 6 fixing the image transferred onto the sheet S, and a discharge roller pair 7 capable of discharging the sheet to a discharge tray 8.

When an image formation job is output to the printer 1, an image formation process is started by the image forming portion 30 based on image-information which is input by an outside computer coupled to the printer 1 and the like. The image forming portion 30 includes a laser scanner 52, a process cartridge P including a photosensitive drum 51, and a transfer roller 531. In adjacent to the photosensitive drum 51, a charge roller, a development roller, and the like, not shown, are disposed. The photosensitive drum 51 and the transfer roller 531 form a transfer nip T1.

The laser scanner 52 irradiates the photosensitive drum 51 with a laser beam based on the input image-information. At this time, the photosensitive drum 51 has been charged by the charge roller in advance, and an electrostatic latent image is formed on the photosensitive drum 51 by being irradiated with the laser beam. Thereafter, this electrostatic latent image is developed by the development roller, and the monochrome toner image is formed on the photosensitive drum 51.

In parallel with the image formation process described above, the sheet S is fed from the feed unit 2. The feed unit 2 includes a cassette 3, which is detachable from and attachable to an apparatus body 1A of the printer 1, a feed roller 21, and a separation roller pair 22. The sheet S stored in the cassette 3 is fed by the feed roller 21, and the sheet S fed by the feed roller 21 is separated into one sheet at a time by the separation roller pair 22.

To be noted, it is acceptable to provide an intermediate board capable of supporting the sheet and capable of ascending and descending to the cassette 3 and, for example, is acceptable to lift the intermediate board by inputting the image formation job, and bring the sheet, supported on the intermediate board, and the feed roller 21 into contact with each other. Further, it is acceptable that one of a pair of rollers of the separation roller pair 22 is a pad or the like, and it is possible to apply a torque limiter method or a retard roller method to the separation roller pair 22.

The toner image on the photosensitive drum 51 is transferred to the sheet S, sent out by the feed unit 2 and conveyed by the conveyance roller pair 41, at the transfer nip T1 by electrostatic load bias applied by the transfer roller 531. Residual toner remained on the photosensitive drum 51 is recovered by a cleaning blade, not shown. The sheet S on which the toner image has been transferred is provided with a predetermined heat and pressure by a fixing film 61 and a press roller 62 of the fixing unit 6, and the toner is melted and adhered (fixed). Inside the fixing film 61, a heating element such as a ceramic heater is disposed. The sheet S passed through the fixing unit 6 is discharged to the discharge tray 8 by the discharge roller pair 7.

In a case where the images are formed on both surfaces of the sheet S, the sheet S with the image formed on a first surface is conveyed to a duplex conveyance path CP in a switchback manner by an inversion roller pair 65. The duplex conveyance path CP guides the sheet S to the conveyance roller pair 41. Then, the sheet S is conveyed to the transfer nip T1 again by the conveyance roller pair 41, and the image is formed on a second surface at the transfer nip T1, and the sheet S is discharged to the discharge tray 8.

Sheet Conveyance Apparatus

Figure 2:
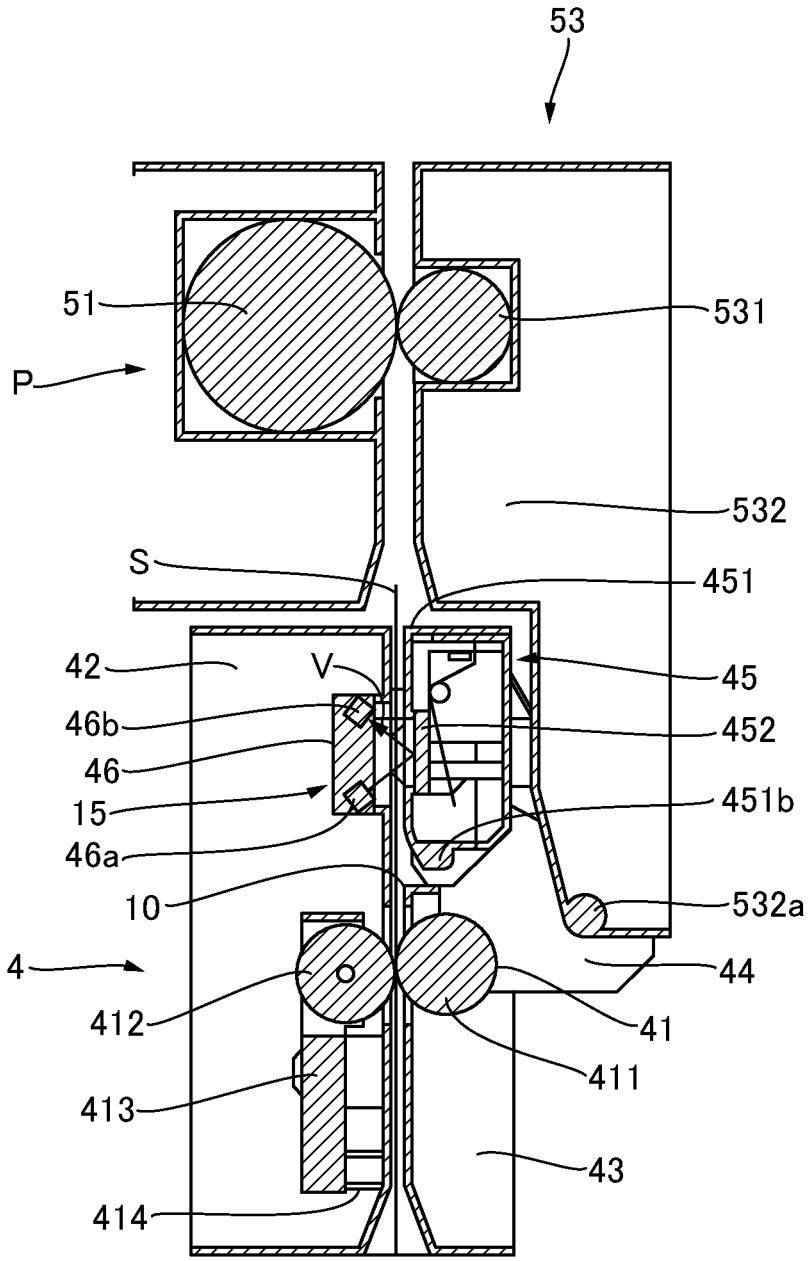
FIG. 2 is a cross-sectional view showing a sheet conveyance apparatus.

Next, the sheet conveyance apparatus 4 will be described in detail. As shown in FIG. 2, the sheet conveyance apparatus 4 includes a conveyance frame 42, serving as a first guide disposed below the process cartridge P and guiding the sheet, and a side plate 44. The side plate 44 supports a conveyance inlet guide 43 facing the conveyance frame 42, and a conveyance guide unit 45 facing the conveyance frame 42 and disposed above the conveyance inlet guide 43.

The conveyance frame 42, the conveyance inlet guide 43, and a conveyance guide 451 of the conveyance guide unit 45 form a conveyance path 10, and the conveyance roller pair 41, serving as a conveyance portion, conveys the sheet S in the conveyance path 10.

The conveyance inlet guide 43 rotatably supports a drive roller 411 of the conveyance roller pair 41. The conveyance frame 42 supports a holder 413 rotatably supporting a driven roller 412 of the conveyance roller pair 41, and an optical sensor 46. The driven roller 412 is urged toward the drive roller 411 by a spring 414 disposed between the holder 413 and the conveyance frame 42, and is rotatably driven by the drive roller 411. The optical sensor 46, serving as a first detection portion, includes a light-irradiating portion 46*a*, which irradiates light, and a light-receiving portion 46*b*, which receives the light emitted from the light-irradiating portion 46*a*. To be noted, a transfer frame 532 of a transfer portion 53, described later, also constitutes a part of the sheet conveyance apparatus 4. The transfer frame 532 is pivotably supported by the side plate 44 around a transfer frame shaft 532*a*.

Transfer Portion

Figure 3:
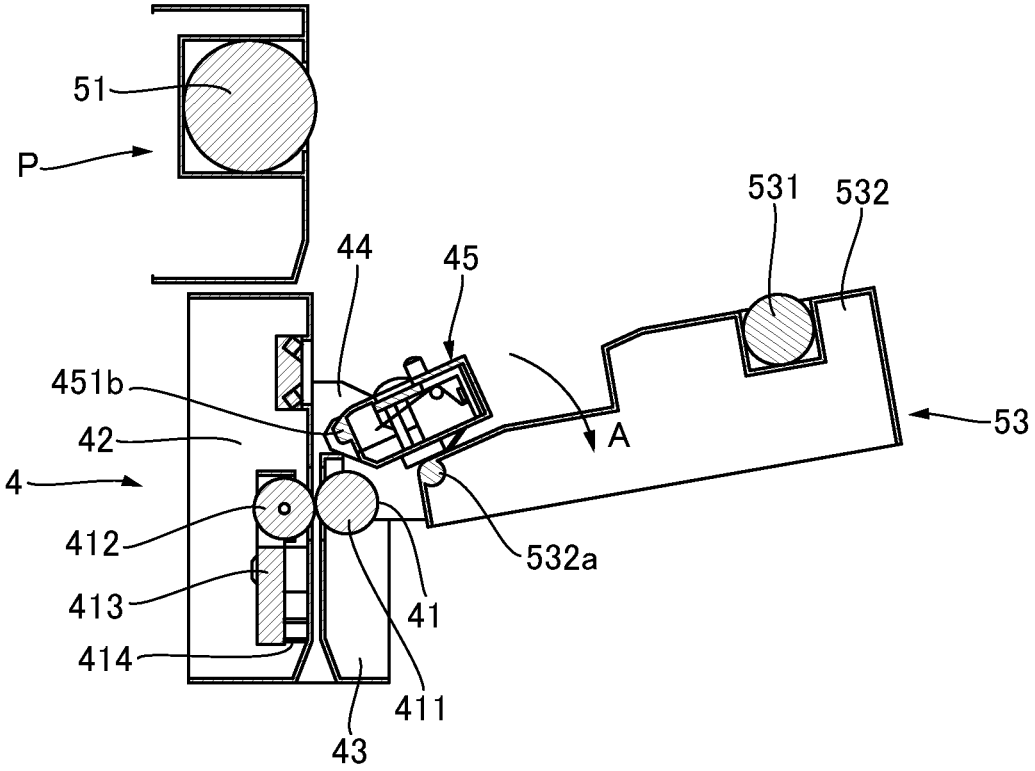
FIG. 3 is a cross-sectional view showing the sheet conveyance apparatus and a transfer portion.

Next, the transfer portion 53 will be described in detail. The transfer portion 53, as shown in FIGS. 2 and 3, includes the transfer roller 531, which is rotatably supported by the transfer frame 532 and serves as a transfer portion. The transfer frame 532 is locked to the apparatus body 1A (refer to FIG. 1) by being locked by a locking member, not shown.

The reason why the transfer frame 532 is provided in the manner of pivotable around the transfer frame shaft 532*a* as the center is, when a jam occurs in the conveyance path 10, to secure a space to deal with a jamming sheet.

As shown in FIG. 3, in a case where the jam occurs in the conveyance path 10, a door, not shown, of the printer 1 is opened, and the transfer frame 532 is opened in an arrow A direction. Hereupon, the conveyance guide unit 45 is opened toward a side of the transfer frame 532 at the same time, and it is possible to access the conveyance path 10. When the jam has been dealt with and the door, not shown, has been closed, the transfer frame 532 and the conveyance guide unit 45 are closed in tandem.

Conveyance Guide Unit

Next, the conveyance guide unit 45 will be described in detail. The conveyance guide unit 45 includes, as shown in FIGS. 4 to 6B, the conveyance guide 451 pivotably supported with respect to the side plate 44 (refer to FIG. 3) around a pivot axis 451*b*, and a holding member 454 pivotably supported by the pivot axis 451*b* as the center. The holding member 454 is, independently from the conveyance guide 451, pivotable between a closed position shown in FIG. 6A and an open position shown in FIG. 6B with respect to the conveyance guide 451, serving as a second guide. In a state where the transfer frame 532 is opened, the holding member 454 is pivotable in an arrow B direction (refer to FIG. 6B) between the closed position and the open position.

A groove portion 11 is formed on an upper side of the conveyance guide 451. The holding member 454 includes a protruded portion 454*a* which protrudes upward, and the protruded portion 454*a* engages with the groove portion 11 of the conveyance guide 451 in a width direction W (refer to FIG. 5) orthogonal to a sheet conveyance direction CD. On the other hand, in a state where the holding member 454 is positioned at the closed position, the protruded portion 454*a* does not engage with the groove portion 11 in the sheet conveyance direction CD and an urging direction UD orthogonal to the width direction W.

That is, in a state where the holding member 454 is positioned at the closed position, the protruded portion 454*a* does not engage with the conveyance guide 451 in the urging direction UD, and is separated from the conveyance guide 451. Therefore, although unitized, these conveyance guide 451 and holding member 454 are capable of pivoting independently from each other.

Figure 4:
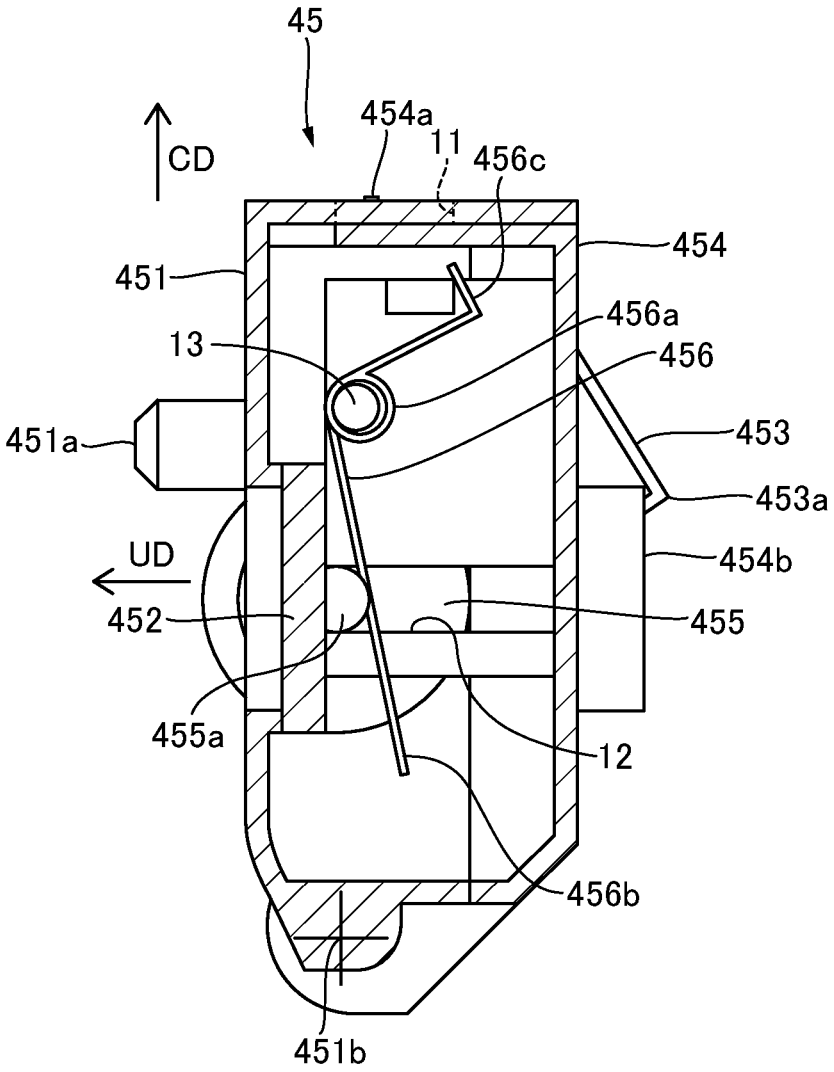
FIG. 4 is a cross-sectional view showing a conveyance guide unit.
Figure 5:
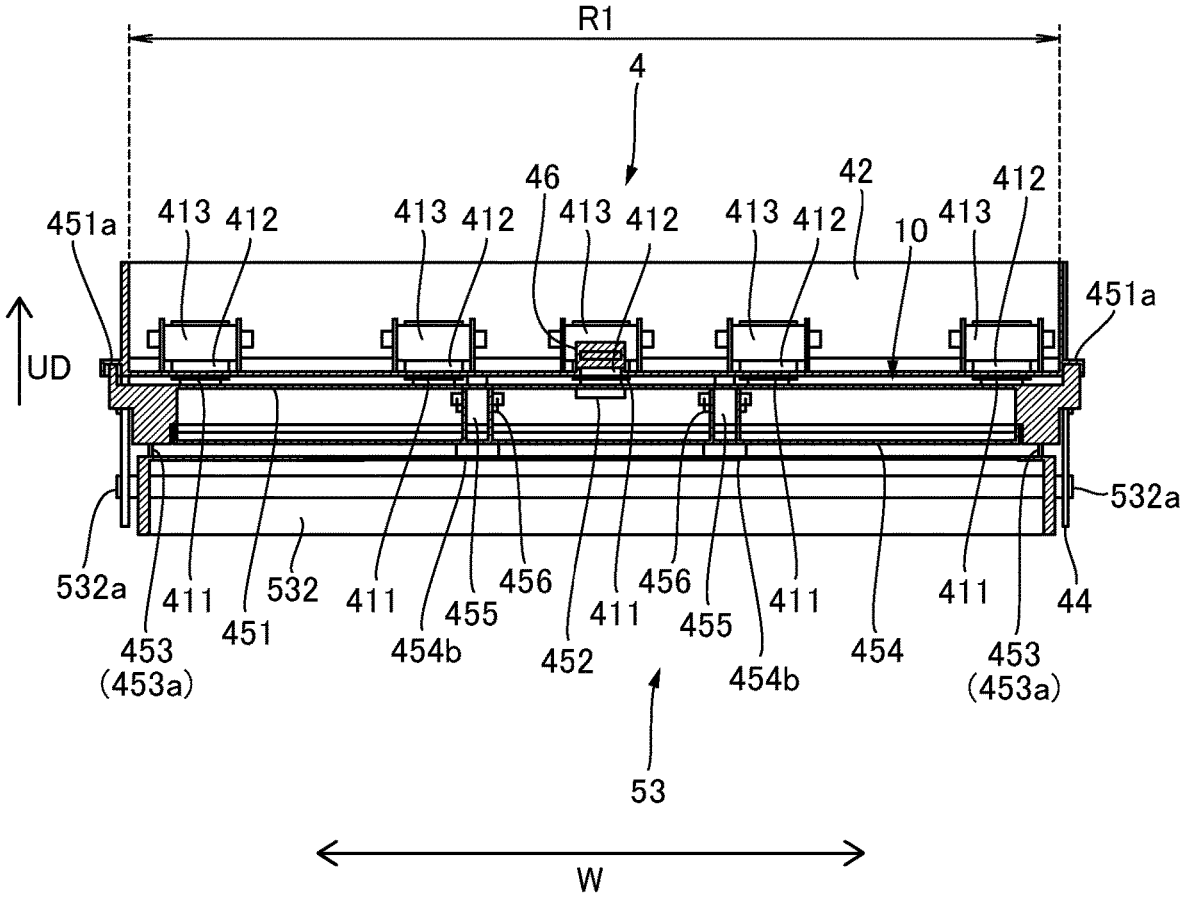
FIG. 5 is the cross-sectional view showing the conveyance guide unit.
Figure 6A:
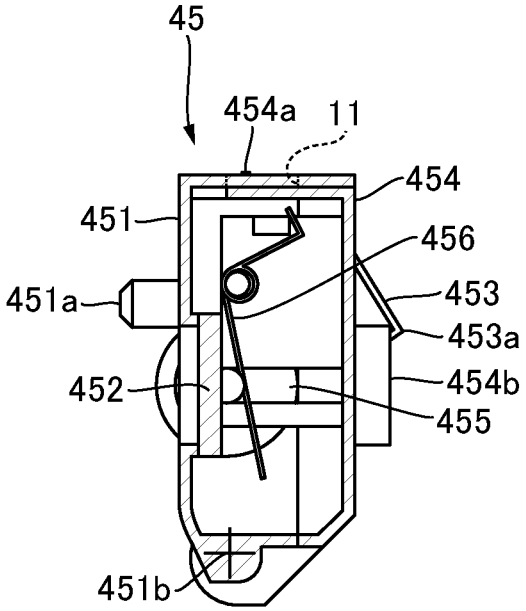
FIG. 6A is a cross-sectional view showing a holding member positioned at a closed position.
Figure 6B:
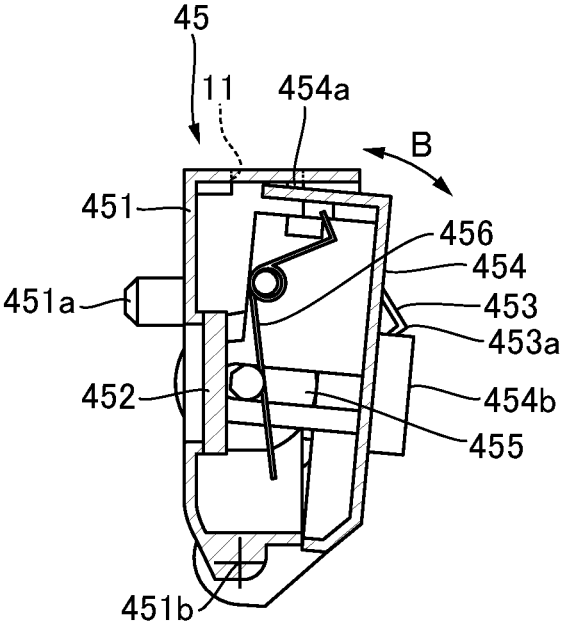
FIG. 6B is the cross-sectional view showing the holding member positioned at an open position.

FIG. 5 is a cross-sectional view, which extends in the width direction W and the urging direction UD, showing the conveyance guide unit 45. The conveyance guide unit 45 includes, as shown in FIGS. 4 and 5, a guide spring 453, serving as a second urging portion, which urges the conveyance guide 451 toward the conveyance frame 42 (refer to FIG. 2). A one-end 453*a* of the guide spring 453 is coupled to the transfer frame 532, and the other end is coupled to the conveyance guide 451.

The conveyance guide 451 includes abutment portions 451*a*, 451*a* which abut on the conveyance frame 42, and the abutment portions 451*a*, 451*a*, serving as a second abutment part, are disposed outside an area R1 of width of the conveyance path 10 in the width direction W. As described above, the conveyance guide 451 is positioned with respect to the conveyance frame 42 in a state where the abutment portions 451*a*, 451*a* are pressed against the conveyance frame 42 by an urging force of the guide spring 453, and where by the transfer frame 532 receives a reaction force of the guide spring 453.

The transfer frame 532 receives the reaction force of the guide spring 453 at the one-end 453*a*. The one-end 453*a* is disposed adjacent to the transfer frame shaft 532*a*, which is a pivot shaft of the transfer frame 532, in the width direction W. Therefore, the reaction force received by the transfer frame 532 from the one-end 453*a* hardly deforms the transfer frame 532 in the urging direction UD.

Further, the conveyance guide 451, as shown in FIG. 2, supports a reflecting plate 452*a*, serving as a reflecting portion to reflect the light irradiated from the light-irradiating portion 46*a* to the light-receiving portion 46*b*, and serving as a second detection portion. The reflecting plate 452 faces the optical sensor 46. The optical sensor 46, including the light-irradiating portion 46*a* the light-receiving portion 46*b*, and the reflecting plate 452 constitute a detection unit 15, and the detection unit 15 is disposed across the conveyance frame 42 and the conveyance guide 451. The optical sensor 46 and the reflecting plate 452 are disposed at a center area of the conveyance path 10 in the width direction W. Further, a distance and a positional relationship between the optical sensor 46 and the reflecting plate 452 are secured by abutting the conveyance guide 451 on the conveyance frame 42 and thus positioning the conveyance guide 451.

As shown in FIGS. 4 and 5, the holding member 454, serving as a receiving member, rotatably holds a pressing roller 455, serving as a pressing portion and a rotary member. More particularly, the holding member 454 includes a long hole 12, and a rotation shaft 455*a* of the pressing roller 455 is rotatably supported by the long hole 12. Further, the long hole 12 extends in the urging direction UD, and the rotation shaft 455*a* of the pressing roller 455 is movable inside the long hole 12 in the urging direction UD. The pressing roller 455 is rotatably driven by the sheet S conveyed in the conveyance path 10.

The conveyance guide unit 45 includes a holding member spring 456, serving as an urging portion and a first urging portion to urge the pressing roller 455 toward the conveyance frame 42 (refer to FIG. 2). The holding member spring 456 includes a coil portion 456*a* fitted into a boss portion 13 provided in the holding member 454, and a one-end 456*b* extending from the coil portion 456*a* to a one-direction and urging the rotation shaft 455*a* of the pressing roller 455 in the urging direction UD. Further, the holding member spring 456 includes the other end 456*c* extending from the coil portion 456*a* to the other direction and being coupled to the holding member 454.

Although the rotation shaft 455*a* of the pressing roller 455 is movable inside the long hole 12, since the rotation shaft 455*a* is urged in the urging direction UD by the holding member spring 456, the pressing roller 455 is always pressed against the conveyance frame 42.

Although, by receiving a reaction force of the holding member spring 456, the holding member 454 attempts to displace in a direction opposite of the urging direction UD, an abutment portion 454*b* of the holding member 454 abuts on the transfer frame 532. That is, the transfer frame 532, serving as a positioning member and a frame, positions the holding member 454 by abutting on the abutment portion 454*b* of the holding member 454 and thus receiving the reaction force of the holding member spring 456.

To be noted, as shown in FIG. 5, the pressing rollers 455, the holding member springs 456, and the abutment portions 454*b*, although provided two for each, are symmetrically disposed with respect to the center line of the conveyance path 10 in the width direction W. The abutment portion 454*b*, serving as a first abutment portion, is disposed inside the area R1 in the width of the conveyance path 10 in the width direction W.

In this way, the holding member 454 is positioned with respect to the conveyance frame 42 in a state where the pressing roller 455 is pressed against the conveyance frame 42 by the urging force of the holding member spring 456, and the transfer frame 532 receives the reaction force of the holding member spring 456.

Sheet Detection Process

Next, a detection process of the detection unit 15 will be described. As shown in FIG. 2, the light irradiated from the light-irradiating portion 46*a* of the optical sensor 46 in an arrow V direction is reflected by the reflecting plate 452 disposed on an opposite side across the conveyance path 10. The light reflected by the reflecting plate 452 is received at the light-receiving portion 46*b* of the optical sensor 46.

When the sheet S reaches a detection position in the conveyance path 10, the light irradiated from the light-irradiating portion 46*a* is blocked by the sheet S before reaching the reflecting plate 452, and the light-receiving portion 46*b* does not receive the light. Since in this way a state of the light-receiving portion 46*b* of the detection unit 15 is switched from a light-receiving state to a light-blocked state, an output value of the light-receiving portion 46*b* is changed, and presence of the sheet S at the detection position is detected.

In this detection process, the sheet S is pressed against the conveyance frame 42 by the pressing roller 455, and is conveyed along the conveyance frame 42. This is because, if a position in a thickness direction of the sheet S is changed inside the conveyance path 10, timing of the sheet S to block the light changes, and timing of the detection unit 15 to detect the presence of the sheet S varies. In this embodiment, since the sheet S is detected at the detection position with the sheet being pressed against the conveyance frame 42 by the pressing roller 455, it is possible to improve detection accuracy. When a trailing edge of the sheet S has passed through the detection position, the light-receiving portion 46*b* becomes the light-receiving state again. Thus, the detection unit 15 changes the output value based on the presence and absence of the sheet S at the detection position.

Effect of Reaction Force of Holding Member Spring on Detection Unit

Next, an effect of the reaction force of the holding member spring 456 on the detection unit 15 will be described with reference to FIGS. 4 and 5. As described above, the reaction force of the holding member spring 456 is received by the transfer frame 532 via the abutment portion 454*b* of the holding member 454.

It occurs that the transfer frame 532 sustains a creep deformation by continuing to receive this reaction force. Then, the holding member 454 positioned by the transfer frame 532 is also displaced. For example, in a case where the conveyance guide 451 has been also displaced by displacement of the holding member 454, a position of the reflecting plate 452 varies, and there is a possibility that the light-receiving portion 46*b* is not able to receive a reflected light from the reflecting plate 452. Then, the detection unit 15 detects erroneously, and becomes not able to correctly detect a defective conveyance such as an occurrence of the jam.

However, in this embodiment, a large gap is provided in the urging direction UD between the protruded portion 454*a* of the holding member 454 and the groove portion 11 of the conveyance guide 451. In other words, inside the area R1, the holding member 454 does not engage with the conveyance guide 451 in the urging direction UD.

Therefore, in a case where the transfer frame 532 is displaced by the effect of the reaction force of the guide spring 453, the holding member 454 also varies the position along with the displacement of the transfer frame 532. On the other hand, the conveyance guide 451 does not vary a position since the gap between the protruded portion 454*a* and the groove portion 11 absorbs a variation of the position of the holding member 454. Herewith, the position of the reflecting plate 452 supported by the conveyance guide 451 also does not vary.

As described above, in this embodiment, the conveyance guide 451 and the holding member 454 are movably disposed with respect to the conveyance frame 42, and are positioned independently from each other with respect to the conveyance frame 42. Herewith, even if the holding member 454 varies the position in the urging direction UD by the effect of the reaction force of the guide spring 453, the position of conveyance guide 451 supporting the reflecting plate 452 is not affected. Therefore, the distance between the optical sensor 46 and the reflecting plate 452 is kept constant, and it is possible to improve the accuracy to detect the sheet S.

Further, even if the transfer frame 532 is displaced in the center area in the width direction W by being pressed by the abutment portion 454*b* of the holding member 454, the displacement of the transfer frame 532 is small in adjacent to the transfer frame shaft 532*a* of the transfer frame 532. Then, since the conveyance guide 451 is abutting on a position adjacent to the transfer frame shaft 532*a* of the transfer frame 532 via the one-end 453*a* of the guide spring 453, the conveyance guide 451 is hardly affected by the displacement of the transfer frame 532. That is, the conveyance guide 451 is not affected by the displacement of the holding member 454. Therefore, it is possible to improve the accuracy to detect the sheet S.

Further, since the sheet S is always pressed by the pressing roller 455, a posture of the sheet S passing through the conveyance path 10 is stabilized, and it is possible to improve the accuracy to detect the sheet S.

Second Embodiment

Next, although a second embodiment of the present disclosure will be described, only the configuration of the detection unit 15 of the first embodiment is changed in the second embodiment. Therefore, illustrations of similar configurations to the first embodiment will be omitted herein, or descriptions will be provided by putting the same reference characters on drawings.

Figure 7:
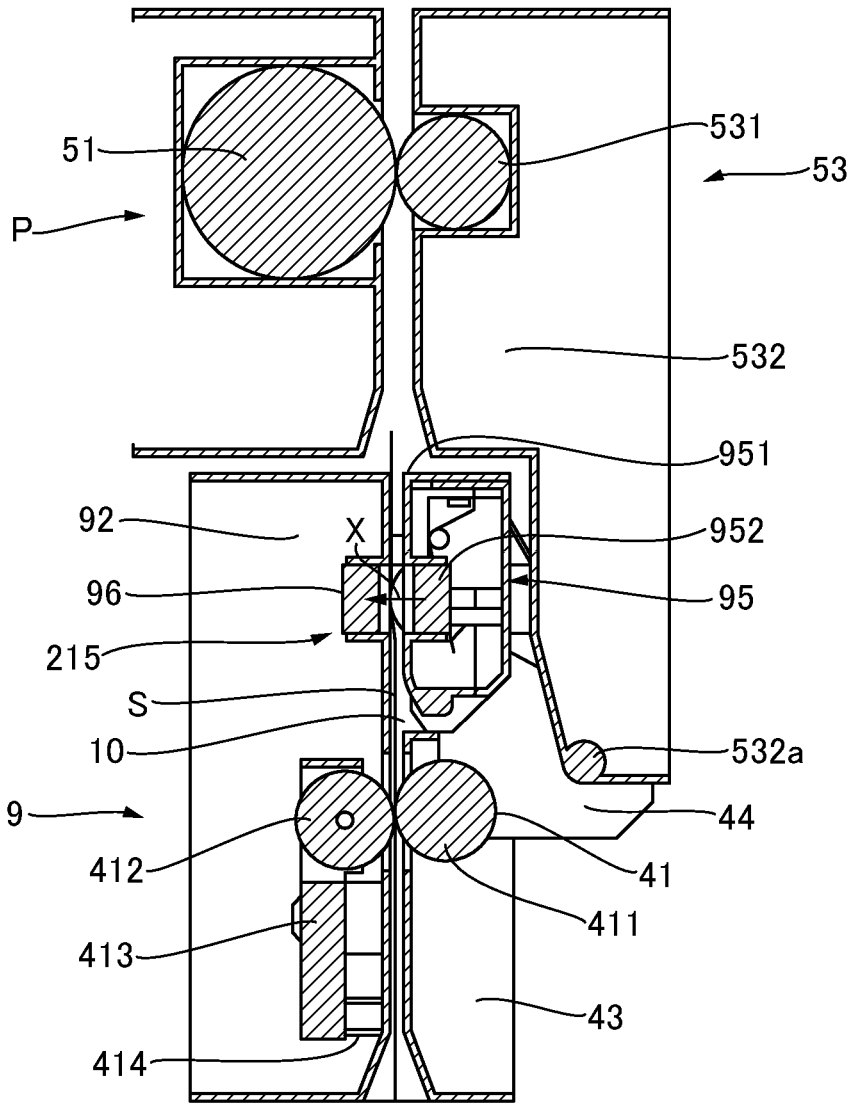
FIG. 7 is a cross-sectional view showing a conveyance guide unit according to a second embodiment.
Figure 8:
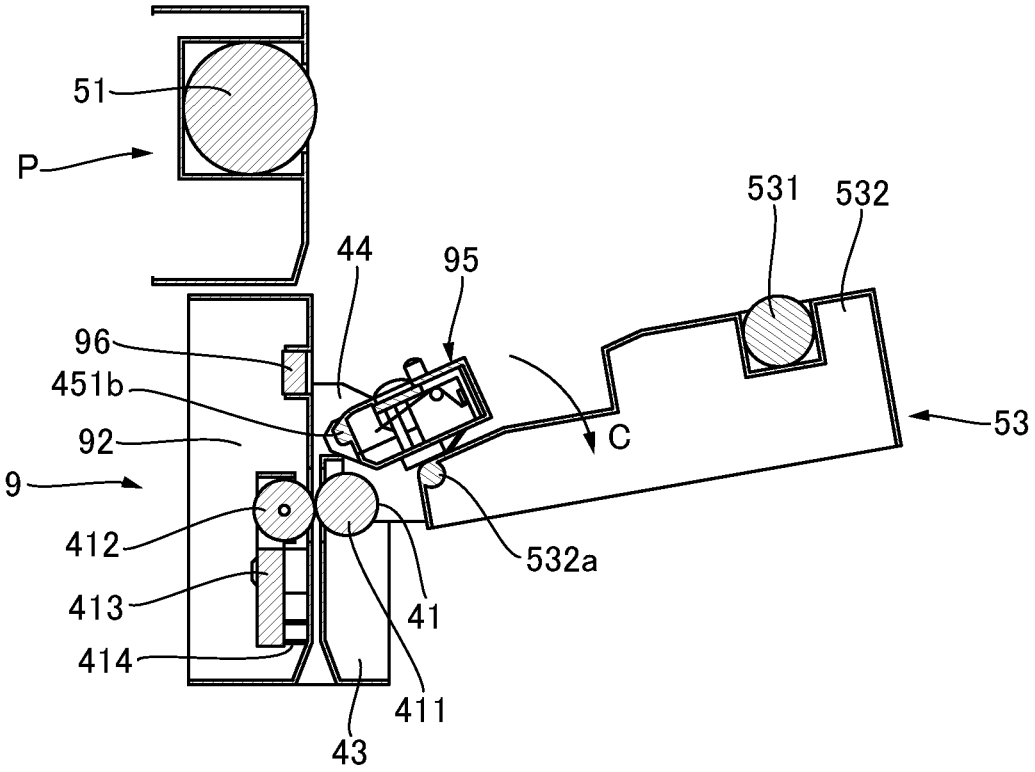
FIG. 8 is a cross-sectional view showing a sheet conveyance apparatus and a transfer portion.
Figure 9:
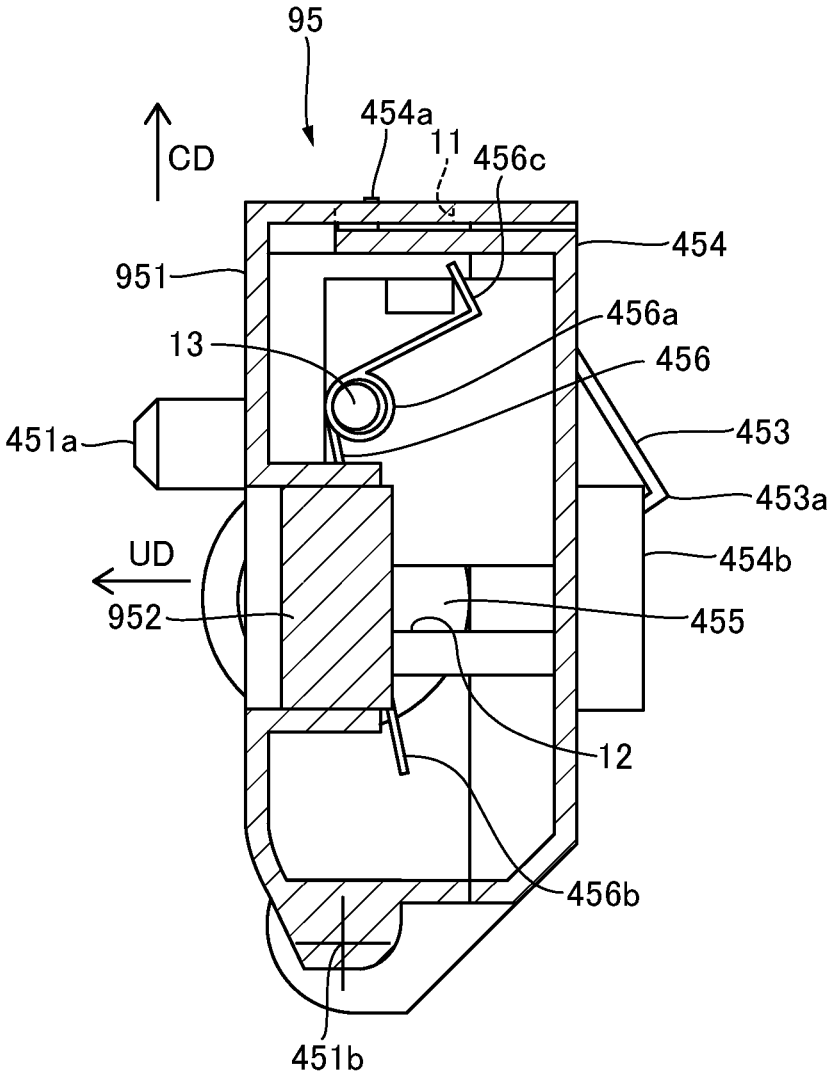
FIG. 9 is a cross-sectional view showing a conveyance guide unit.
Figure 10:
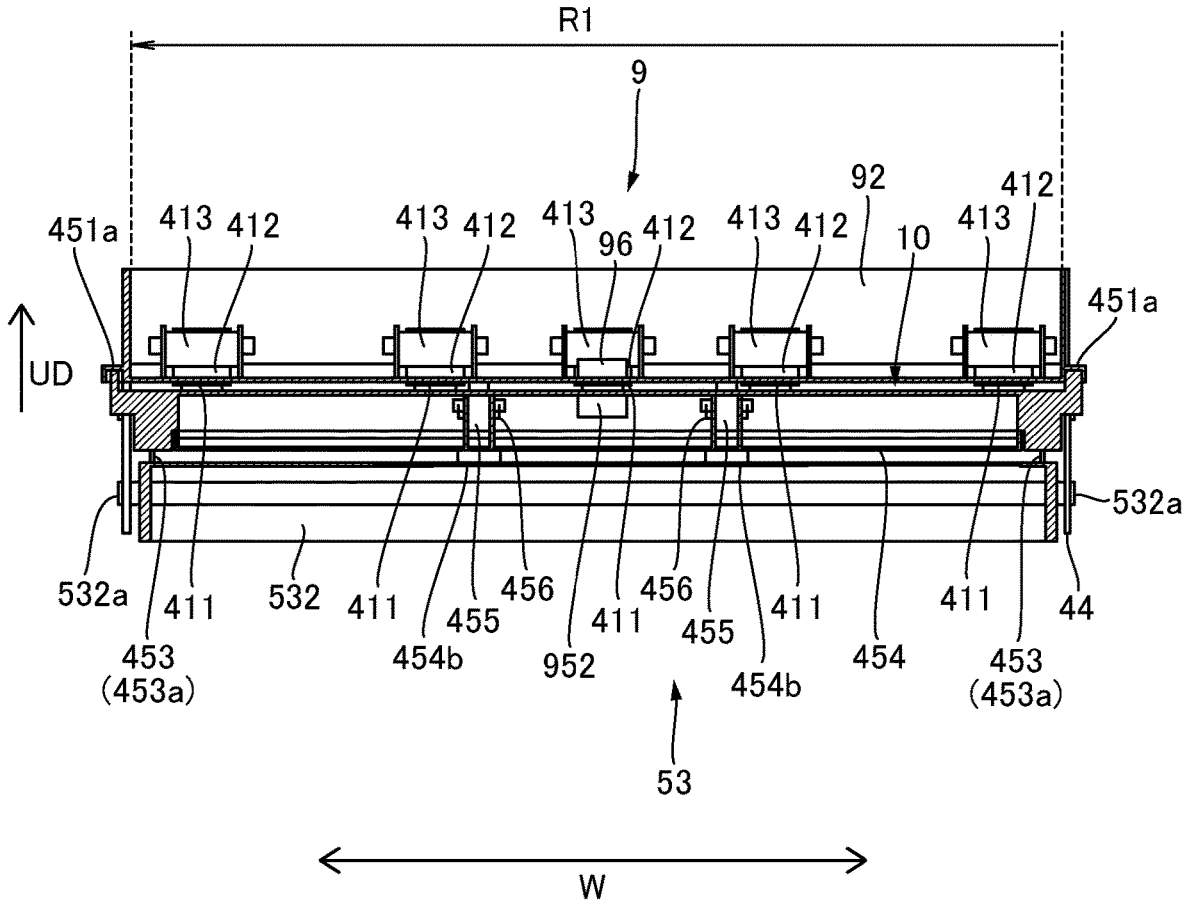
FIG. 10 is a cross-sectional view showing the conveyance guide unit.
Figure 11A:
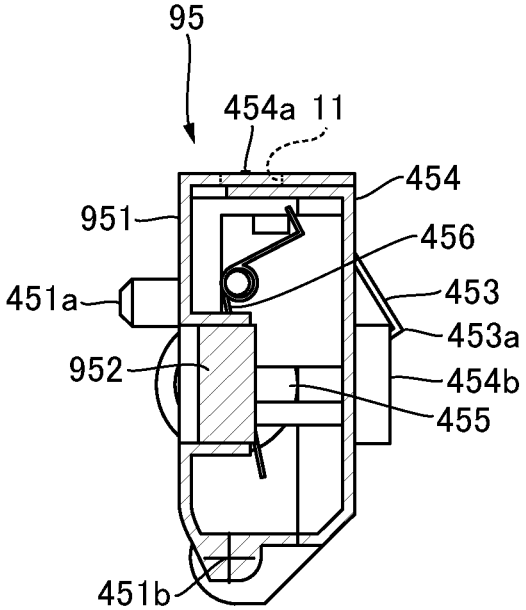
FIG. 11A is a cross-sectional view showing a holding member positioned at a closed position.
Figure 11B:
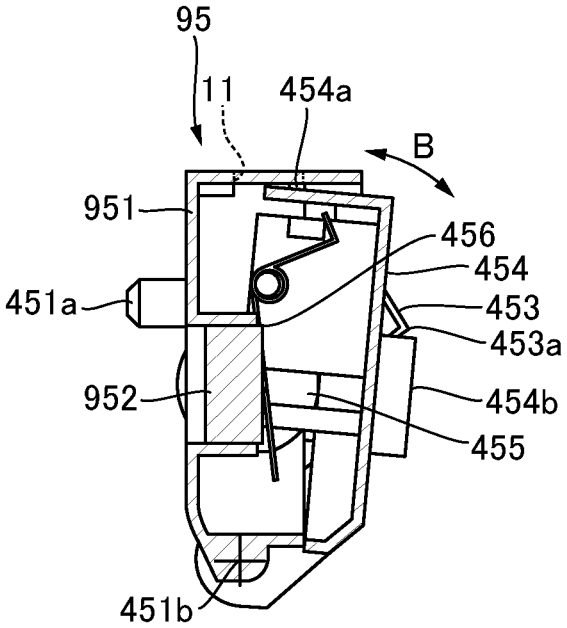
FIG. 11B is the cross-sectional view showing the holding member positioned at an open position.

A sheet conveyance apparatus 9 according to the second embodiment includes, as shown in FIGS. 7 and 8, a conveyance frame 92, serving as a first guide, and the side plate 44. The side plate 44 pivotably supports a conveyance guide unit 95. The conveyance frame 92 supports an ultrasonic wave receiving element 96, serving as a first detection portion, which receives an ultrasonic wave.

The conveyance guide unit 95 includes, as shown in FIGS. 9 to 11B, a conveyance guide 951, serving as a second guide, and the holding member 454. The conveyance guide 951 and the holding member 454 are unitized similar to the first embodiment. The conveyance guide 951 supports an ultrasonic wave transmitting element 952, serving as a second detection portion, which faces the ultrasonic wave receiving element 96 across the conveyance path 10.

The ultrasonic wave receiving element 96 and the ultrasonic wave transmitting element 952 constitute a detection unit 215, and the detection unit 215 is disposed across the conveyance frame 92 and the conveyance guide 951. The ultrasonic wave receiving element 96 and the ultrasonic wave transmitting element 952 are disposed in the center area of the conveyance path 10 in the width direction W. Further, a distance and positional relationship between the ultrasonic wave receiving element 96 and the ultrasonic wave transmitting element 952 are secured by abutting the conveyance guide 951 on the conveyance frame 92 and thus positioning the conveyance guide 951.

Sheet Detection Process

Next, a detection process of the detection unit 215 will be described. As shown in FIG. 7, the ultrasonic wave transmitted in an arrow X direction from the ultrasonic wave transmitting element 952 is received by the ultrasonic wave receiving element 96 disposed on an opposite side across the conveyance path 10. At this time, since a degree of attenuation at a time when the ultrasonic wave passes through the sheet S changes depending on thickness and density of the sheet S, it is possible to detect physical properties of the sheet S passing through the conveyance path 10 by judging this degree of the attenuation from the ultrasonic wave received by the ultrasonic wave receiving element 96.

In this detection process, the sheet S is pressed against the conveyance frame 92 by the pressing roller 455, and conveyed along the conveyance frame 92. Herewith, a variation in the degree of the attenuation due to a passing position of the sheet S is reduced, and it is possible to improve the detection accuracy. In a case of the detection unit 215 configured like this embodiment, levels of transmission and reception of the ultrasonic wave transmitting element 952 and the ultrasonic wave receiving element 96 are adjusted after assembled to the sheet conveyance apparatus 9. Receiving sensitivity after the adjustment is affected by a change in the distance between the ultrasonic wave transmitting element 952 and the ultrasonic wave receiving element 96, it is necessary to keep this distance constant.

As described above, in this embodiment, an ultrasonic wave sensor is applied to the detection unit 215. Also, in this case, if the position of the holding member 454 is varied in the urging direction UD by the effect of the reaction force of the guide spring 453, a position of the conveyance guide 951 supporting the ultrasonic wave transmitting element 952 is not affected. Therefore, the distance between the ultrasonic wave transmitting element 952 and the ultrasonic wave receiving element 96 is kept constant, and it is possible to improve the accuracy to detect the sheet S. Further, since the sheet S is always pressed by the pressing roller 455, the posture of the sheet S passing through the conveyance path 10 is stabilized, and it is possible to improve the accuracy to detect the sheet S.

Alternatives to Embodiments

To be noted, although the optical sensor 46, serving as the first detection portion, which includes the light-irradiating portion 46*a* and the light-receiving portion 46*b*, is disposed on the conveyance frame 42 and the reflecting plate 452, serving as the second detection portion, is disposed on the conveyance guide 451, it is not limited to this. For example, it is acceptable to dispose the reflecting plate 452 on the conveyance frame 42 and dispose the optical sensor 46 on the conveyance guide 451. In any case where the optical sensor 46 and the reflecting plate 452 are respectively disposed across the conveyance frame 42 and the conveyance guide 451, it is acceptable that the optical sensor 46 is disposed on either one of the conveyance frame 42 and the conveyance guide 451 and the reflecting plate 452 is disposed on the other.

Further, although, in the second embodiment, the ultrasonic wave receiving element 96 is disposed on the conveyance frame 92 and the ultrasonic wave transmitting element 952 is disposed on the conveyance guide 951, it is not limited to this. For example, it is acceptable to dispose the ultrasonic wave transmitting element 952 on the conveyance frame 92 and dispose the ultrasonic wave receiving element 96 on the conveyance guide 951. Further, it is acceptable to dispose the light-receiving portion or the light-irradiating portion in place of the ultrasonic wave receiving element 96 and dispose the light-irradiating portion or the light-receiving portion in place of the ultrasonic wave transmitting element 952.

Figure 12:
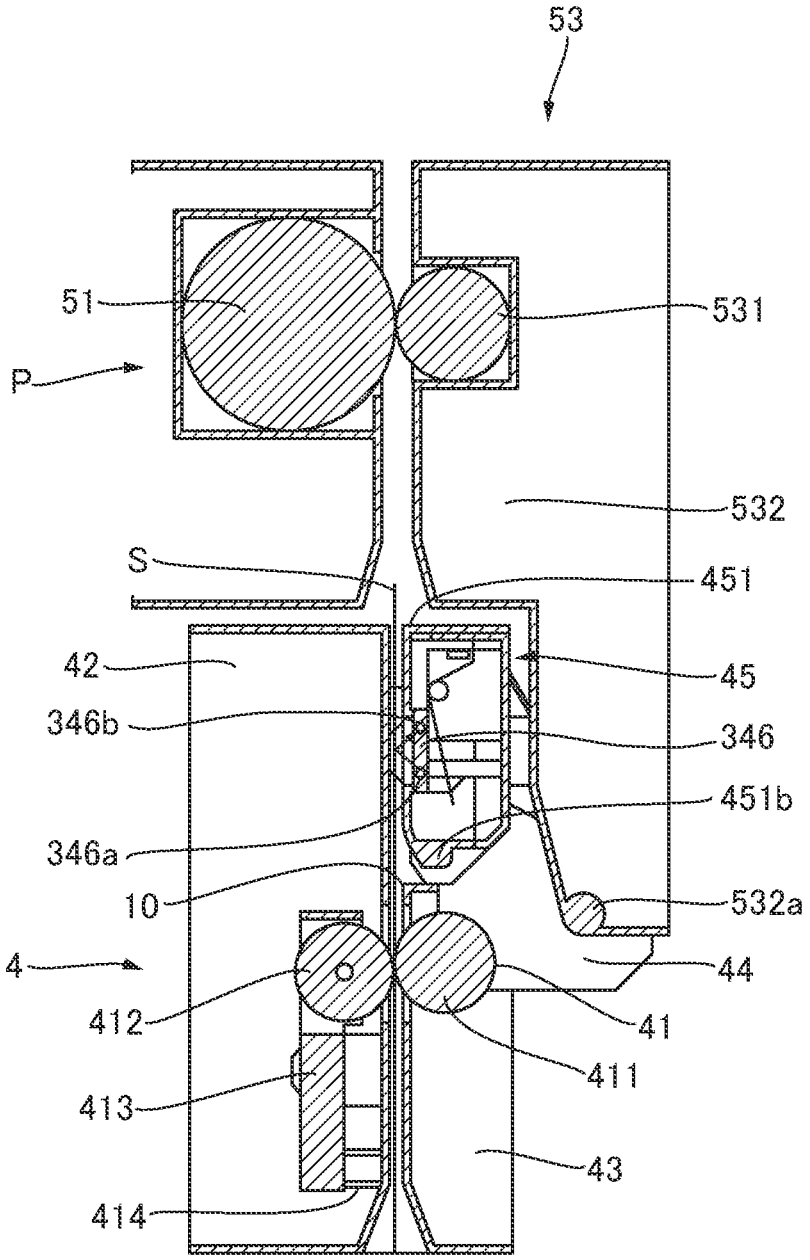
FIG. 12 is a cross-sectional view showing a sheet conveyance apparatus according to alternatives to the embodiments.

Further, although, in any of the embodiments described above, the detection unit 15, 215 is disposed across the conveyance frame and the conveyance guide, it is not limited to this. For example, as shown in FIG. 12, it is acceptable to dispose an optical sensor 346, serving as a detection portion, on the conveyance guide 451 and not to dispose a detection element of the detection unit on the conveyance frame 42.

The optical sensor 346 includes a light-irradiating portion 346*a* and a light-receiving portion 346*b*, and light irradiated from the light-irradiating portion 346*a* is reflected by the sheet S being conveyed in the conveyance path 10, and is received by the light-receiving portion 346*b*. The optical sensor 346 changes an output value based on a light-receiving or light-blocked state. As described above, even if the detection elements of the detection unit are disposed only on the conveyance guide 451, since the conveyance guide 451 is not affected by a positional variation (displacement) of the holding member 454, it is possible to improve the accuracy to detect the sheet S.

Figure 13:
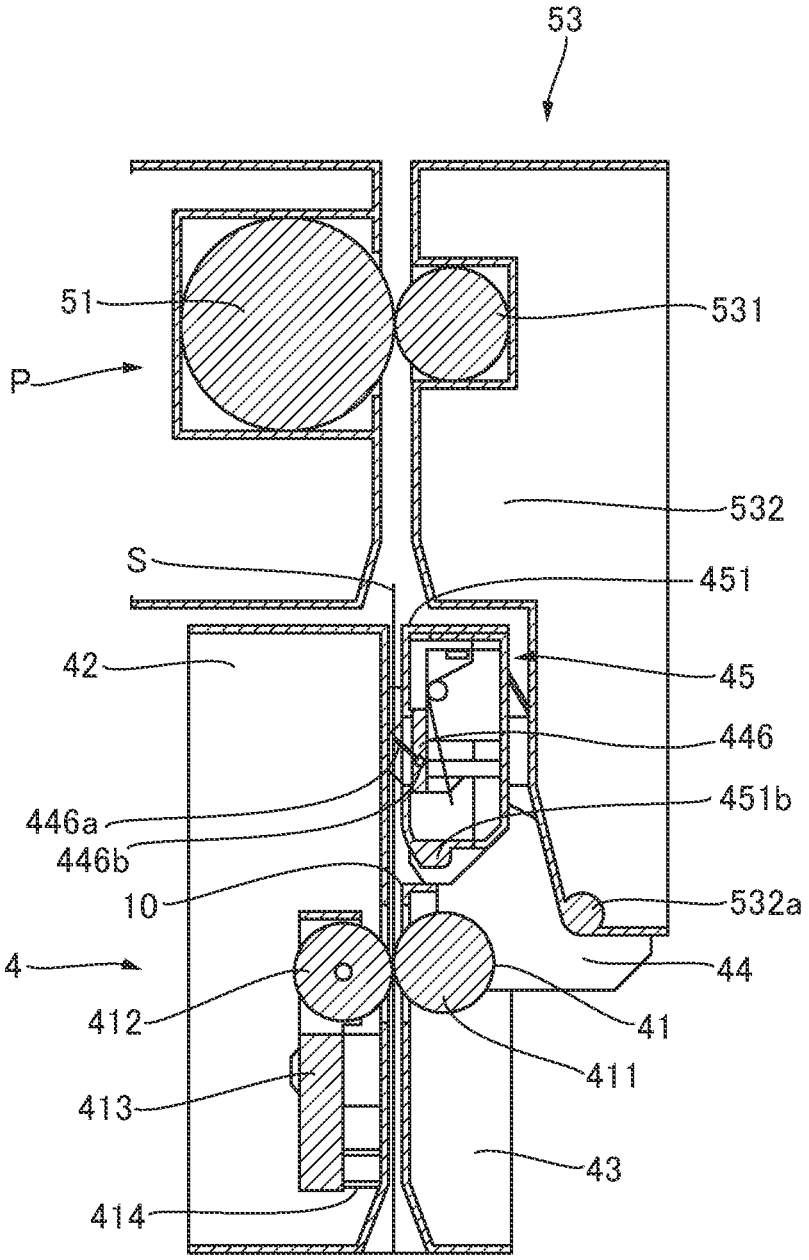
FIG. 13 is a cross-sectional view showing a sheet conveyance apparatus according to the alternatives to the embodiments.

Further, as shown in FIG. 13, it is acceptable that the conveyance guide 451 supports a detection portion 446 and detection elements of the detection unit are not disposed on the conveyance frame 42. The detection portion 446 includes a moving member 446*a*, which moves by being pressed by the sheet, and an output member 446*b*, which changes an output value based on a position of the moving member 446*a*. That is, the detection portion 446 is a flag method sensor detecting the sheet S by a movement of a mechanical flag. An optical sensor, for example, is applied to the output member 446*b*. Further, it is suitable that the moving member 446*a* is disposed to abut on the sheet S at a certain degree of a shallow angle so as to reduce a collision noise.

Further, although, in any of the embodiments described above, the sheet S is pressed against the conveyance frame by the pressing roller 455, it is not limited to this. For example, it is acceptable to provide a low sliding resistance rib shape to the holding member 454 in place of the pressing roller 455. Further, it is not limited to a roller, and acceptable to apply other rotary members, such as a belt.

Further, although, in any of the embodiments described above, the holding member 454 is positioned by receiving the reaction force of the holding member spring 456 by the transfer frame 532, it is not limited to this. For example, it is acceptable to position the holding member 454 by receiving the reaction force of the holding member spring 456 by the side plate 44 or other frames of the apparatus body 1A.

Further, although, in any of the embodiments described above, the conveyance guide 451, 951 and the holding member 454 are configured to pivot, it is not limited to this. For example, it is acceptable to configure the conveyance guide 451, 951 and the holding member 454 to move in linear motion.

Further, although, in any of the embodiments described above, the pressing roller 455 is directly pressed against the conveyance frame 42, 92, it is not limited to this. For example, it is acceptable to dispose a locking member at a position where the pressing roller 455 and the conveyance frame come into contact with each other. The locking member is configured not to engage with the conveyance frame in the urging direction UD, and is pressed by the pressing roller. Herewith, even in a case where it is not possible to secure rigidity of the conveyance frame adequately, it is possible to reduce a displacement of the conveyance frame due to being pressed by the pressing roller 455, and possible to improve the detection accuracy.

Further, although, in any of the embodiments described above, descriptions are provided using the printer 1 of the electrophotographic system, the present disclosure is not limited to this. For example, it is possible to apply the present disclosure to an image forming apparatus of an ink jet system which forms the image on the sheet by ejecting a liquid ink through a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-235145, filed Dec. 25, 2019, which is hereby incorporated by reference herein in its entirety.

What is claimed is:

1. A sheet conveyance apparatus comprising:

a first guide configured to guide a sheet;

a second guide disposed to face the first guide, and configured to form a conveyance path together with the first guide, the second guide being pivotably supported around a pivot axis;

a conveyance portion configured to convey a sheet in the conveyance path;

a pressing portion configured to press the sheet being conveyed in the conveyance path against the first guide;

an urging portion configured to urge the pressing portion in an urging direction toward the first guide;

a receiving member configured to hold the pressing portion and receive a reaction force of the urging portion; and a detection unit comprising a first detection portion disposed on the first guide, and a second detection portion facing the first detection portion and disposed on the second guide, the detection unit being configured to change an output value based on presence and absence of the sheet at a detection position in the conveyance path, wherein the second guide provided with the second detection portion, and the receiving member are movably disposed with respect to the first guide provided with the first detection portion respectively, and are configured to be positioned with respect to the first guide independently from each other, and wherein the receiving member is pivotably supported around the pivot axis independently from the second guide.

2. The sheet conveyance apparatus according to claim 1, wherein either one of the first detection portion and the second detection portion comprises an ultrasonic wave receiving element configured to receive an ultrasonic wave, and wherein another one of the first detection portion and the second detection portion comprises an ultrasonic wave transmitting element configured to emit the ultrasonic wave to the ultrasonic wave receiving element.

3. The sheet conveyance apparatus according to claim 1, wherein either one of the first detection portion and the second detection portion comprises a light-irradiating portion configured to emit light, and a light-receiving portion configured to receive the light emitted from the light-irradiating portion, and wherein another one of the first detection portion and the second detection portion comprises a reflecting portion configured to reflect the light emitted from the light-irradiating portion toward the light-receiving portion.

4. The sheet conveyance apparatus according to claim 1, wherein the second guide is configured not to be affected by displacement of the receiving member.

5. The sheet conveyance apparatus according to claim 1, wherein the receiving member is configured not to engage with the second guide in the urging direction inside an area of width of the conveyance path in a width direction orthogonal to a sheet conveyance direction.

6. The sheet conveyance apparatus according to claim 5, wherein the urging portion is a first urging portion, wherein the sheet conveyance apparatus further comprises:

a positioning member configured to position the receiving member by abutting the receiving member and receiving a reaction force of the first urging portion; and a second urging portion configured to urge the second guide toward the first guide, wherein the receiving member comprises a first abutment part configured to abut the positioning member and disposed inside the area in the width direction, and wherein the second guide comprises a second abutment part configured to abut the first guide and disposed outside the area in the width direction.

7. The sheet conveyance apparatus according to claim 6, wherein the second guide is configured to be positioned with respect to the first guide in a state where the second abutment part is pressed against the first guide by an urging force of the second urging portion, and where the positioning member receives a reaction force of the second urging portion, and wherein the receiving member is configured to be positioned with respect to the first guide in a state where the pressing portion is pressed against the first guide by an urging force of the first urging portion, and where the positioning member receives a reaction force of the first urging portion.

8. The sheet conveyance apparatus according to claim 6, wherein the positioning member comprises a frame configured to support a transfer portion transferring an image onto the sheet.

9. The sheet conveyance apparatus according to claim 1, wherein the pressing portion comprises a rotary member configured to be rotatably driven by the sheet being conveyed in the conveyance path.

10. An image forming apparatus comprising:

the sheet conveyance apparatus according to claim 1; and an image forming portion forming an image on a sheet.

11. A sheet conveyance apparatus comprising:

a first guide configured to guide a sheet;

a second guide disposed to face the first guide, and configured to form a conveyance path together with the first guide;

a conveyance portion configured to convey a sheet in the conveyance path;

a pressing portion configured to press the sheet being conveyed in the conveyance path against the first guide;

an urging portion configured to urge the pressing portion in an urging direction toward the first guide;

a receiving member configured to hold the pressing portion and receive a reaction force of the urging portion; and a detection unit comprising a detection portion disposed on the second guide, the detection unit being configured to change an output value based on presence and absence of the sheet at a detection position in the conveyance path, wherein the second guide provided with the detection portion, and the receiving member are movably disposed with respect to the first guide respectively, and are configured to be positioned with respect to the first guide independently from each other.

12. The sheet conveyance apparatus according to claim 11, wherein the detection portion comprises a light-irradiating portion configured to emit light, and a light-receiving portion configured to receive the light emitted from the light-irradiating portion and reflected by the sheet.

13. The sheet conveyance apparatus according to claim 11, wherein the detection portion comprises a moving member configured to be moved by being pressed by the sheet, and an output member configured to change the output value based on a position of the moving member.

14. The sheet conveyance apparatus according to claim 11, wherein the second guide is configured not to be affected by displacement of the receiving member.

15. The sheet conveyance apparatus according to claim 11, wherein the receiving member is configured not to engage with the second guide in the urging direction inside an area of width of the conveyance path in a width direction orthogonal to a sheet conveyance direction.

16. The sheet conveyance apparatus according to claim 15, wherein the urging portion is a first urging portion, wherein the sheet conveyance apparatus further comprises:

a positioning member configured to position the receiving member by abutting the receiving member and receiving a reaction force of the first urging portion; and a second urging portion configured to urge the second guide toward the first guide, wherein the receiving member comprises a first abutment part configured to abut the positioning member and disposed inside the area in the width direction, and wherein the second guide comprises a second abutment part configured to abut the first guide and disposed outside the area in the width direction.

17. The sheet conveyance apparatus according to claim 16, wherein the second guide is configured to be positioned with respect to the first guide in a state where the second abutment part is pressed against the first guide by an urging force of the second urging portion, and where the positioning member receives a reaction force of the second urging portion, and wherein the receiving member is configured to be positioned with respect to the first guide in a state where the pressing portion is pressed against the first guide by an urging force of the first urging portion, and where the positioning member receives a reaction force of the first urging portion.

18. The sheet conveyance apparatus according to claim 16, wherein the positioning member comprises a frame configured to support a transfer portion transferring an image onto the sheet.

19. The sheet conveyance apparatus according to claim 11, wherein the second guide is pivotably supported around a pivot axis, and wherein the receiving member is supported around the pivot axis independently from the second guide.

20. The sheet conveyance apparatus according to claim 11, wherein the pressing portion comprises a rotary member configured to be rotatably driven by the sheet being conveyed in the conveyance path.

21. An image forming apparatus comprising:

the sheet conveyance apparatus according to claim 11; and an image forming portion forming an image on a sheet.

* * * * *